US007246828B2

(12) United States Patent
Kitzis

(10) Patent No.: US 7,246,828 B2
(45) Date of Patent: Jul. 24, 2007

(54) REFINED ANTI-ANIMAL CONTAINER LOCK

(76) Inventor: Roger S. Kitzis, 156 Plainview Rd., Woodbury, NY (US) 11797

( * ) Notice: Subject to any disclaimer, the term of this patent is extended or adjusted under 35 U.S.C. 154(b) by 12 days.

(21) Appl. No.: 11/195,130

(22) Filed: Aug. 2, 2005

(65) Prior Publication Data

US 2007/0029819 A1 Feb. 8, 2007

(51) Int. Cl.
*E05C 19/00* (2006.01)

(52) U.S. Cl. ..... 292/253; 292/DIG. 37; 292/DIG. 16; 292/300

(58) Field of Classification Search ..... 292/327, 292/300, 304, 49, 27, DIG. 37, 253, DIG. 16
See application file for complete search history.

(56) References Cited

U.S. PATENT DOCUMENTS 2,411,115 A * 11/1946 Rifkin ..... 292/325
2,717,167 A 9/1955 Worth
3,363,924 A 1/1968 Remig
3,534,650 A * 10/1970 Kubokawa ..... 411/344
3,596,554 A 8/1971 Low
3,669,481 A * 6/1972 Bergmann ..... 292/49
3,935,964 A 2/1976 Saxe
4,136,596 A 1/1979 Davis
4,204,711 A * 5/1980 Lancelot et al. ..... 294/89
4,339,853 A 7/1982 Lipschitz
4,384,656 A 5/1983 McQuiston et al.
4,471,980 A 9/1984 Hickman
4,489,851 A 12/1984 Russ
4,534,488 A 8/1985 Boggs et al.
4,666,054 A 5/1987 Jaicks
4,936,726 A 6/1990 Medard
5,061,112 A 10/1991 Monford, Jr.
5,118,144 A 6/1992 Garofalo
5,160,180 A 11/1992 Mlynarczyk
5,228,815 A 7/1993 Gignac et al.
5,368,347 A 11/1994 Holtman et al.
5,411,161 A 5/1995 Fish, Jr.
5,419,598 A 5/1995 Kreitzer
5,474,341 A 12/1995 Putman et al.
5,494,323 A 2/1996 Huang
5,531,551 A 7/1996 Bowers
5,599,050 A 2/1997 Tinsley
5,671,957 A 9/1997 Raffini
6,077,011 A 6/2000 Walker
6,193,261 B1 2/2001 Hahka
6,290,093 B1 9/2001 Obriot et al.
6,338,591 B1 1/2002 Lilienthal, II
6,339,944 B1 1/2002 Skalka
6,386,789 B1 5/2002 Chausse et al.
6,477,747 B1 * 11/2002 Flagg ..... 24/68 CD
6,722,711 B2 4/2004 Kitzis

* cited by examiner

*Primary Examiner*—Gary Estremsky
(74) *Attorney, Agent, or Firm*—Notaro & Michalos PC

(57) ABSTRACT

A lock for locking a lid to a receptacle has a bolt extending into aligned holes in overlapping parts thereof. A handle is detachably connected to an outer end of the bolt for pulling the bolt. An expansion mechanism in the form of wedges, a chain or other mechanisms, expands to an expanded geometry larger than the aligned holes to prevent withdrawing the bolt, and contracts to a contracted geometry which is at most equal to the dimension of the aligned holes for allowing withdrawing of the bolt. An actuator mounted in the bolt engages the expansion mechanism for moving it from the expanded geometry to the contracted geometry when the actuator is pushed. A biasing spring engaged to the actuator biases it in the withdrawing direction.

6 Claims, 2 Drawing Sheets

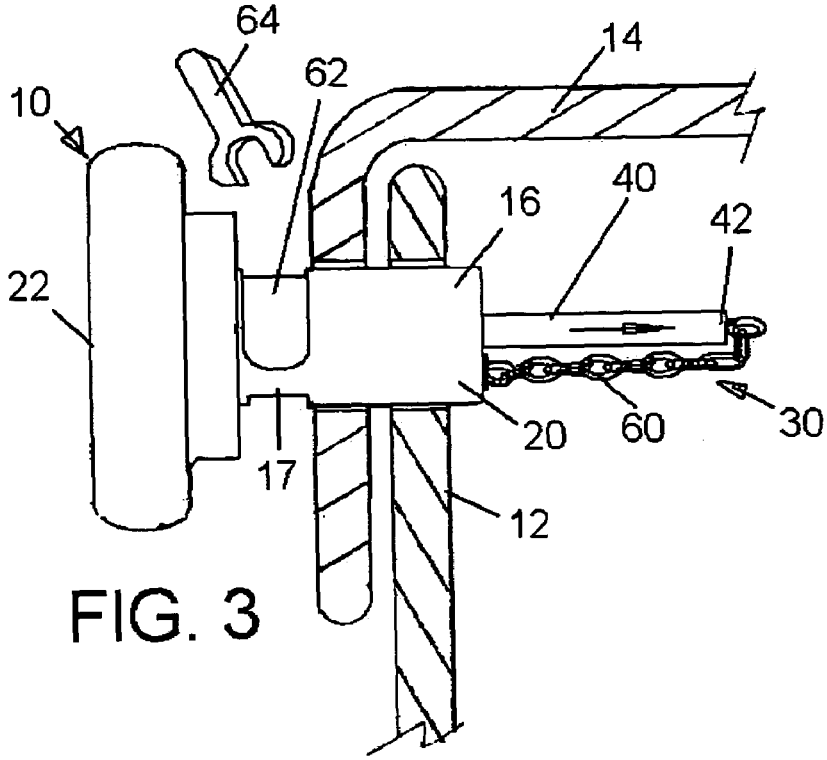
FIG. 3
FIG. 4
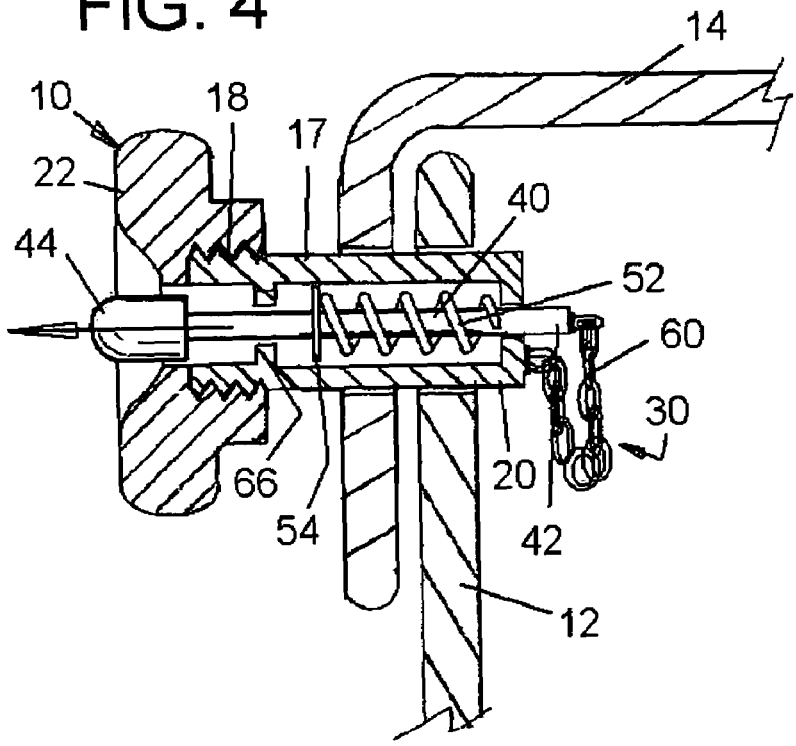

REFINED ANTI-ANIMAL CONTAINER LOCK

FIELD AND BACKGROUND OF THE INVENTION

The present invention relates to locking mechanisms, and, in particular, to a new and useful locking mechanism for containers having bodies and lids with overlapping portions, or cabinets or drawers with overlapping parts, and especially for outside receptacles such as trash cans and recycle bins.

U.S. Pat. No. 6,722,711 issued to the present inventor and incorporated here by reference, discloses a lock for a receptacle and cover with overlapping parts and aligned holes through the overlapping part. A bolt extends into the holes with a handle at one end of the bolt for pulling the bolt out of the aligned holes in a withdrawing direction. An expansion mechanism at an opposite end of the bolt expands to prevent withdrawing of the bolt. Several embodiments of the expansion mechanism are disclosed, any of which are combinable with features of the present invention where appropriate. An actuator mounted for movement to the bolt is pushed to contract and unlock the mechanism in U.S. Pat. No. 6,722,711 and the lock includes a release mechanism for removing the actuator and pushing the remaining parts of the lock into the aligned holes in case the lock has become jammed in the holes. The release mechanism releases the actuator, however, and not the handle as in the present improved invention.

The present invention, like the inventor's previous patent, solves the problem of keeping animals out of household trash containers thus preventing the mess that often is the result of an animal getting into the garbage can and rummaging through the contents of the container. The present invention can also keep young children out of drawers or cabinets.

Others have attempted to incorporate locking mechanisms in the design of a trash receptacle, such as hinged handles that engage grooves or ridges in the cover to inhibit the removal of the lid, or straps that attempt to hold the lip in place, or even levers that clamp the cover onto the container while in the upright position. See, for example: U.S. Pat. No. 2,717,167 for a Container Cover fastener; U.S. Pat. No. 3,363,924 for a Releasable Tension holder for Removeable Receptacle Covers; U.S. Pat. No. 3,935,964 for Trash Can Protector; U.S. Pat. No. 4,384,656 for Trash Receptacle Having Lid Fastening Means; U.S. Pat. No. 4,489,851 for Container Cover Lock; U.S. Pat. No. 4,534,488 for Locking Device for Garbage Can Lid; U.S. Pat. No. 4,666,054 for Animal Proof Storage Container Apparatus; U.S. Pat. No. 5,118,144 for Garbage Can Lid Latch; U.S. Pat. No. 5,411,161 for Container Having Twist-Locking Cover; U.S. Pat. No. 5,419,598 for Lock for Trash Bins; U.S. Pat. No. 5,474,341 for Gravity Actuated Container Lock; U.S. Pat. No. 5,599,050 for Lid-Locking Device for Trash Containers; U.S. Pat. No. 6,290,093 for Device for Locking the Cover of a Container, and Container So Equipped; and U.S. Pat. No. 6,339,944 for Locking Mechanism for Trash Can Receptacle and Other Doors.

The problem with prior designs is that they fail to function if the can is knocked over and the animal can then use one or more limbs to paw their way to "unlock" the securing mechanism. The present invention takes advantage of the fundamental difference between primate and non-primate animals. The fact that primates have an opposing thumb makes it impossible for non-primates to release the "lock" mechanism of the invention and then remove the lock to permit opening of the cover.

Also see the patents which were cited in the inventor's previous U.S. Pat. No. 6,722,711, namely: U.S. Pat. No. 3,596,554 to Low et al.; U.S. Pat. No. 4,136,596 to Davis, Jr.; U.S. Pat. No. 4,339,853 Lipschitz; U.S. Pat. No. 4,471,980 to Hickman; U.S. Pat. No. 4,936,726 to Medard; U.S. Pat. No. 5,061,112 to Monford, Jr.; U.S. Pat. No. 5,160,180, to Mlynarczyk; U.S. Pat. No. 5,228,815 to Gignac et al.; U.S. Pat. No. 5,368,347 to Holtman et al.; U.S. Pat. No. 5,494,323 to Huang; U.S. Pat. No. 5,531,551 to Bowers; U.S. Pat. No. 5,671,957 to Raffini; U.S. Pat. No. 6,077,011 to Walker; U.S. Pat. No. 6,193,261 to Hahka; U.S. Pat. No. 6,338,591 to Lilienthal, II; and U.S. Pat. No. 6,386,789 to Chausse et al.

Various locking mechanisms are known and used in a variety of other fields as well. U.S. Pat. No. 6,077,011, for example, discloses a Push Button Panel Fastener, which utilizes captured balls that can be engaged against the recess of a pin for detachably connecting two parts to each other.

The present invention improves on the inventor's prior patent by providing even better expansion mechanisms and an improved release scheme in case the lock becomes jammed in the receptacle.

SUMMARY OF THE INVENTION

An object of the present invention is to provide a lock which is easily and quickly engaged to lock the lid of a container in place, but which cannot be removed by the type of animals which would normally raid garbage pails, such as racoons and the like. The lock generally cannot be removed by any non-primate nor by young children who have not yet developed adequate manual dexterity.

Accordingly, an object of the invention is to provide a lock for locking a lid to a receptacle, the receptacle and lid having overlapping parts with aligned holes, the lock comprising: a bolt for extending at least partly into at least one of the aligned holes in the overlapping parts, the bolt having an outer end adapted to be outside the lid and receptacle, an inner end adapted to be inside the lid and receptacle when the bolt is in use, and an outer dimension which is smaller than an inner dimension of the aligned holes; a handle having an outer dimension that is larger than the inner dimension of the aligned holes, the handle being detachably connected to the outer end of the bolt for pulling the bolt out of the aligned holes in a withdrawing direction, the handle being movable with respect to the bolt so as to be detached from the bolt to allow the bolt to be pushed into the receptacle, through the aligned holes when the handle is removed from the bolt; expansion means operatively connected to the inner end of the bolt for expanding to an expanded geometry having at least one dimension which is greater than a dimension of the aligned holes to prevent withdrawing the bolt from the aligned holes, the expansion means having a contracted geometry which is at most equal to the dimension of the aligned holes for allowing withdrawing of the bolt from the aligned holes; an actuator mounted for linear movement to the bolt and having an actuation end operatively engaged with the expansion means for allowing movement of the expansion means from the expanded geometry to the contracted geometry when the actuator is pushed in an unlocking direction which is opposite from the withdrawing direction, the actuator having a button end adjacent the handle for engagement to push the actuator in the unlocking direction; biasing means engaged to the actuator for biasing the actuator in the withdrawing direction with respect to the bolt for moving the expansion means toward the expanded geometry so that when the actuator is not being pushed in the unlocking direction, the expansion means is in the expanded geometry; and holding means at the outer end of the bolt for holding the bolt against movement so that the handle can be detached from the bolt.

A further object of the invention is to provide such a lock, with or without the handle releasing feature but wherein the expansion means comprises at least one wedge pivotally mounted to the bolt near the inner end of the bolt, the actuation end of the actuator being engaged to the wedge for moving the wedge into the expanded geometry of the expansion means when the actuator is bias by the biasing means in the withdrawing direction with respect to the bolt.

A still further object of the invention is to provide such a lock, with or without the releasing feature but wherein the expansion means comprises a chain having a plurality of links, the chain being connected between the inner end of the bolt and the actuation end of the actuator so that when the actuator is pushed in the unlocking direction, the chain is straightened into the contracted geometry of the expansion means, and when the actuator is moved in the withdrawing direction under biasing by the biasing means, the chain moves into the expanded geometry of the expansion means.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is a view similar to FIG. 1 of another embodiment of the lock of the present invention in the unlocked, insertion condition; and FIG. 4 is a view similar to FIG. 2 of the second embodiment of the invention in the locked condition.

DESCRIPTION OF THE PREFERRED EMBODIMENTS

Figure 1:
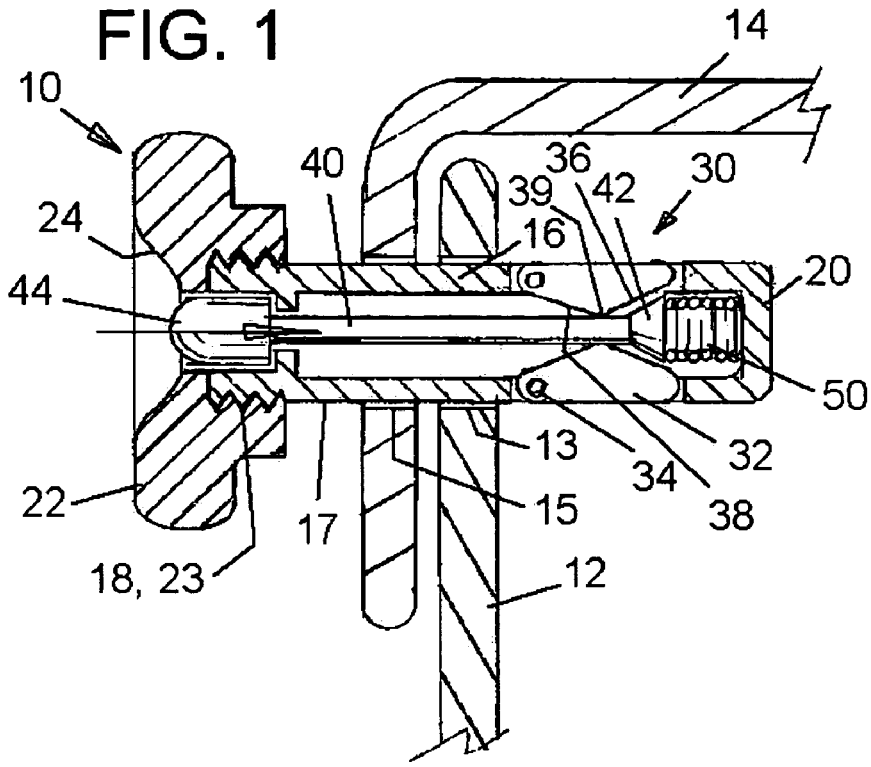
FIG. 1 is a sectional view of a first embodiment of the lock of the invention in a position for insertion into the aligned holes in a receptacle and lid with overlapping parts.
Figure 2:
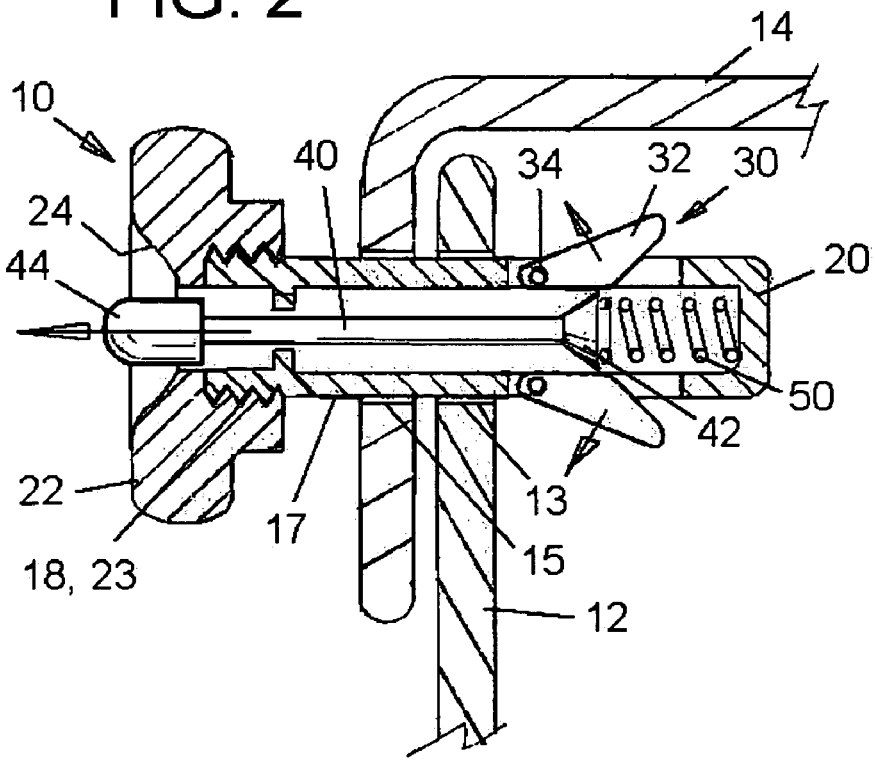
FIG. 2 is a view similar to FIG. 1 of the lock in a locked condition.

Referring to the drawings in particular wherein the same reference numerals are utilized to designate the same or functionally similar parts, the invention disclosed in FIGS. 1 and 2, is a lock generally designated 10 for a receptacle 12 having a lid 14. The receptacle and lid 12 and 14, have overlapping parts with aligned holes 13 and 15 therethrough. The holes may be any shape but circular holes are preferred since they can easily be made by a household drill passing through the overlapping parts.

The lock of the invention comprises a bolt 16 for extending through the aligned holes 13, 15 of the receptacle and lid. More generally, bolt 16 may extend at least partly into at least one of the aligned holes in the overlapping parts.

The bolt has an outer threaded end 18 adapted to be outside the lid and receptacle, an inner closed end 20 adapted to be inside the lid and receptacle when the bolt is in use, and an outer dimension which is slightly smaller than an inner dimension of the aligned holes 13, 15 so that the bolt can be inserted into the holes for locking the lid to the receptacle.

A handle 22, having an outer dimension that is larger than the inner dimension of the aligned holes, is internally threaded at 23 and is thereby detachably threaded onto the threaded end 18, for pulling the bolt out of the aligned holes in a withdrawing direction, i.e. to the left in FIGS. 1 and 2. The handle is movable with respect to the bolt, that is rotatable on the end of the bolt, so as to be detached from the bolt to allow the bolt to be pushed into the receptacle, through the aligned holes when the handle is removed from the bolt, if the lock should become jammed in the holes. Jamming is a real concern in view of the nature of the contents of the receptacle, e.g. trash, and the need to rapidly unlock the receptacle, e.g. when trash collectors arrive.

The terms "lid" and "receptacle," however, are not meant to limit the invention to trash receptacles but are used in a general sense to designate any type of covering structure, even a cabinet door, and any kind of enclosure, such as a cabinet.

Expansion means generally designated 30 are operatively connected to the inner end 20 of the bolt 16 for expanding to an expanded geometry shown in FIG. 2, having at least one dimension which is greater than a dimension of the aligned holes to prevent withdrawing the bolt from the aligned holes, that is the locked position of the invention. The expansion means also have a contracted geometry illustrated in FIG. 1, which is at most equal to the dimension of the aligned holes for allowing withdrawing of the bolt from the aligned holes.

An actuator 40 is mounted for linear movement to the bolt 16 and has an actuation end 42 operatively engaged with the expansion means 30 for allowing movement of the expansion means from the expanded geometry to the contracted geometry when the actuator is pushed in an unlocking direction which is shown by the right-pointing arrow in FIG. 1 and is opposite from the withdrawing direction (left-pointing arrow in FIG. 2). The actuator also has a button end 44 adjacent the handle for engagement to push the actuator in the unlocking direction. To this end the handle 22 has a recessed or indented outer side 24 that surrounds the button 44 to shield it from accidental activation.

Biasing means, such as a spring 50 in an inner end of an opening in bolt 16, is engaged to the actuator 40 for biasing the actuator in the withdrawing direction with respect to the bolt and thus for moving the expansion means 30 toward the expanded geometry of FIG. 2, so that when the actuator is not being pushed in the unlocking direction, the expansion means is in the expanded geometry and the lid is locked.

Holding means such as an exposed length 17 at the outer end of the bolt 16 that is accessible outside the lid and receptacle, are provided for holding the bolt, e.g. using a wrench, against movement, e.g. rotation, so that the handle 22 can be detached from the bolt, e.g. by unscrewing it from threaded end 18 of the bolt.

The actuator 40 is preferably slidably mounted in the central opening of passage of the bolt.

The expansion means of FIGS. 1 and 2, comprise one or more wedges 32, pivotally mounted at a pin or journal 34 in a slot of the bolt 16, near the inner end 20 of the bolt. The actuation end 42 of the actuator is engaged to the wedge for moving the wedge 32 into the expanded geometry of the expansion means when the actuator is bias by the biasing spring 50 in the withdrawing direction with respect to the bolt. Two, three or more wedges 32 each mounted on a pivot journal 34 and in its own slot can be circumferentially spaced around the inner end 20 of bolt 16 to form the expansion means 30, although only one wedge will also function to lock the bolt in the aligned holes 13, 15.

The bolt 16 has the cental axial opening therein and the actuator 40 is mounted for linear movement in and along this bolt opening. Each wedge 32 has an inner triangular cam surface with an inner inclined surface 36, an outer inclined surface 38 and a peak 39 between the inner and outer inclined surfaces. The actuation end 42 of the actuator 40 may have an inclined actuator surface engaged against the triangular cam surface so that when the actuator is pushed in the unlocking direction of the arrow in FIG. 1, the actuator surface is adjacent or inwardly of the inner inclined surface 36 of the wedge 32 for allowing the expansion means to move to the contracted geometry (with all wedges inside the bolt) for removing the bolt from the aligned holes 13, 15. Alternatively the actuation end 42 may simply be a radially outwardly extending disk or washer near the end of the actuator 40, or an enlarged diameter part of the actuator that can contact the wedge.

When the actuator is released and moves toward the withdrawing direction as in FIG. 2, under the biasing force of spring 50, the inclined actuator surface of actuation end 42 is moved outwardly (to the left in the figures) passed the peak 39 and to a point adjacent the outer inclined surface 38 of the wedge 32 for locking the expansion means in the expanded geometry with the wedges outside the bolt and thus preventing the wedges from moving inwardly toward the contracted geometry. By passing the peak 39, the actuation end 42 thus stabilizes the expanded geometry. Inclined surfaces 36 and 38 are at an angle of about 90 to 170 degrees from each other (preferably about 100 to 140 degrees).

FIGS. 3 and 4 illustrate another embodiment of the invention wherein the lock 10 for locking a lid 14 to the receptacle 12, has a bolt 16 for extending at least partly into at least one of the aligned holes in the overlapping parts, the bolt having an outer end 18 adapted to be outside the lid and receptacle, an inner end 20 adapted to be inside the lid and receptacle when the bolt is in use, and an outer dimension which is smaller than an inner dimension of the aligned holes. The handle 22 has an outer dimension that is larger than the inner dimension of the aligned holes and is connected to the outer end of the bolt for pulling the bolt out of the aligned holes in a withdrawing direction as in the embodiment of FIGS. 1 and 2. An actuator 40 is mounted for linear movement in the bolt and has an actuation end 42. The actuator 40 has a button end 44 adjacent the handle 22 for engagement to push the actuator in an unlocking direction that is opposite to the withdrawing direction.

The expansion means 30 to prevent withdrawing the bolt from the aligned holes in this embodiment, comprises a chain 60 having a plurality of links, the chain being connected between the inner end 20 of the bolt 16 and the actuation end 42 of the actuator so that when the actuator is pushed in the unlocking direction, the chain is straightened into the contracted geometry of FIG. 3, and when the actuator is moved in the withdrawing direction under biasing by the biasing means such as a spring 52 engaged between the inside of the bolt inner end 20 and a ring 54 fixed on the actuator 40, the chain moves into the expanded geometry of FIG. 4. The biasing means or spring 52 thus engages the actuator 40 for biasing it in the withdrawing direction with respect to the bolt for moving the expansion means toward the expanded geometry so that when the actuator is not being pushed in the unlocking direction, the expansion means is in the expanded geometry and the lock is in its locked position.

The holding means in FIGS. 3 and 4, which need not be present in all embodiments of the invention, comprises two opposed flat areas 62 formed on the outer surface of the otherwise cylindrical bolt extension 17 that can be engaged be a wrench 64 to hold the bolt 16 against rotation while the handle 22 is unscrewed from the bolt to allow the bolt to be pushed all the way into the receptacle in case of a jam.

An inner annular ridge 66 is formed on the inner opening through bolt 16 in which the actuator 40 rides, to act as a stop for the larger diameter button 44 when it is pushed in the unlocking direction.

While specific embodiments of the invention have been shown and described in detail to illustrate the application of the principles of the invention, it will be understood that the invention may be embodied otherwise without departing from such principles.

What is claimed is:

1. A lock for locking a lid to a receptacle, the receptacle and lid having overlapping parts with aligned holes, the lock comprising:

a bolt for extending at least partly into at least one of the aligned holes in the overlapping parts, the bolt having an outer end adapted to be outside the lid and receptacle, an inner end adapted to be inside the lid and receptacle when the bolt is in use, and an outer dimension which is smaller than an inner dimension of the aligned holes;

a handle having an outer dimension that is larger than the inner dimension of the aligned holes, the handle being detachably connected to the outer end of the bolt for pulling the bolt out of the aligned holes in a withdrawing direction, the handle being movable with respect to the bolt so as to be detached from the bolt to allow the bolt to be pushed into the receptacle, through the aligned holes when the handle is removed from the bolt;

expansion means operatively connected to the inner end of the bolt for expanding to an expanded geometry having at least one dimension which is greater than a dimension of the aligned holes to prevent withdrawing the bolt from the aligned holes, the expansion means having a contracted geometry which is at most equal to the dimension of the aligned holes for allowing withdrawing of the bolt from the aligned holes;

an actuator mounted for linear movement to the bolt and having an actuation end operatively engaged with the expansion means for allowing movement of the expansion means from the expanded geometry to the contracted geometry when the actuator is pushed in an unlocking direction which is opposite from the withdrawing direction, the actuator having a button end adjacent the handle for engagement to push the actuator in the unlocking direction;

biasing means engaged to the actuator for biasing the actuator in the withdrawing direction with respect to the bolt for moving the expansion means toward the expanded geometry so that when the actuator is not being pushed in the unlocking direction, the expansion means is in the expanded geometry; and holding means at the outer end of the bolt for holding the bolt against movement so that the handle can be detached from the bolt, the expansion means comprising a chain having a plurality of links, the chain being connected between the inner end of the bolt and the actuation end of the actuator so that when the actuator is pushed in the unlocking direction the chain is straightened into the contracted geometry of the expansion means, and when the actuator is moved in the withdrawing direction under biasing by the biasing means, the chain moves into the expanded geometry of the expansion means.

2. A lock according to claim 1, wherein the handle is threadably connected to the outer end of the bolt and the holding means comprised at least one flat area at the outer end of the bolt for holding the bolt against rotation for detachment of the handle by rotation of the handle with respect to the bolt.

3. A lock according to claim 1, wherein the bolt has an opening therein and the actuator is slidably mounted in the opening.

4. A lock according to claim 1, wherein the biasing means comprises a spring for biasing the actuator in the withdrawing direction with respect to the bolt.

5. A lock for locking a lid to a receptacle, the receptacle and lid having overlapping parts with aligned holes, the lock comprising:

a bolt for extending at least partly into at least one of the aligned holes in the overlapping parts, the bolt having an outer end adapted to be outside the lid and receptacle, an inner end adapted to be inside the lid and receptacle when the bolt is in use, and an outer dimension which is smaller than an inner dimension of the aligned holes;

a handle having an outer dimension that is larger than the inner dimension of the aligned holes, the handle being connected to the outer end of the bolt for pulling the bolt out of the aligned holes in a withdrawing direction;

an actuator mounted for linear movement to the bolt and having an actuation end the actuator having a button end adjacent the handle for engagement to push the actuator in an unlocking direction that is opposite to the withdrawing direction;

expansion means operatively connected to the inner end of the bolt for expanding to an expanded geometry having at least one dimension which is greater than a dimension of the aligned holes to prevent withdrawing the bolt from the aligned holes, the expansion means having a contracted geometry which is at most equal to the dimension of the aligned holes for allowing withdrawing of the bolt from the aligned holes, the expansion means comprising a chain having a plurality of links, the chain being connected between the inner end of the bolt and the actuation end of the actuator so that when the actuator is pushed in the unlocking direction, the chain is straightened into the contracted geometry of the expansion means, and when the actuator is moved in the withdrawing direction under biasing by the biasing means, the chain moves into the expanded geometry of the expansion means; and biasing means engaged to the actuator for biasing the actuator in the withdrawing direction with respect to the bolt for moving the expansion means toward the expanded geometry so that when the actuator is not being pushed in the unlocking direction, the expansion means is in the expanded geometry.

6. A lock according to claim 5, wherein the bolt has an opening therein and the actuator is slidably mounted in the opening, the biasing means comprising a spring in the opening of the bolt for biasing the actuator in the withdrawing direction with respect to the bolt.

* * * * *